US007969427B2

(12) United States Patent
Katagawa

(10) Patent No.: US 7,969,427 B2
(45) Date of Patent: Jun. 28, 2011

(54) CONTROL DEVICE FOR DISPLAY PANEL AND DISPLAY APPARATUS HAVING SAME

(75) Inventor: Koichi Katagawa, Kawasaki (JP)

(73) Assignees: Fujitsu Limited, Kawasaki (JP); Au Optronics Corporation, Hsinchu (TW)

( * ) Notice: Subject to any disclaimer, the term of this patent is extended or adjusted under 35 U.S.C. 154(b) by 1257 days.

(21) Appl. No.: 11/087,945

(22) Filed: Mar. 23, 2005

(65) Prior Publication Data

US 2006/0001632 A1 Jan. 5, 2006

(30) Foreign Application Priority Data

Jun. 30, 2004 (JP) ..... 2004-192916

(51) Int. Cl.
*G09G 5/00* (2006.01)

(52) U.S. Cl. ..... 345/204; 345/98; 345/213

(58) Field of Classification Search ..... 345/211–213, 345/530, 204, 98
See application file for complete search history.

(56) References Cited

U.S. PATENT DOCUMENTS

| | | | | |
|---|---|---|---|---|
| 5,218,274 | A | 6/1993 | Zenda | |
| 5,610,621 | A | 3/1997 | Itoh et al. | |
| 5,805,693 | A | 9/1998 | Chang et al. | |
| 6,356,702 | B1 * | 3/2002 | Suzuki | 386/68 |
| 6,466,272 | B1 * | 10/2002 | Arai et al. | 348/555 |
| 2002/0050965 | A1 * | 5/2002 | Oda et al. | 345/87 |
| 2002/0140652 | A1 | 10/2002 | Suzuki et al. | |

FOREIGN PATENT DOCUMENTS

| | | |
|---|---|---|
| EP | 0 411 464 A2 | 2/1991 |
| EP | 0 502 600 | 9/1992 |
| JP | 5-150219 | 6/1993 |
| JP | 2002-006285 | 1/2002 |
| JP | 2002-202763 | 7/2002 |
| JP | 2002-297104 | 10/2002 |
| TW | 284334 | 8/1996 |
| TW | 445443 | 7/2001 |

* cited by examiner

*Primary Examiner* — Kevin M Nguyen
*Assistant Examiner* — Kenneth B Lee, Jr.
(74) *Attorney, Agent, or Firm* — Kratz, Quintos & Hanson, LLP

(57) ABSTRACT

A display panel control device comprises a first buffer, to which a current-frame data, is written in synchronization with a sync signal, and from which the written current-frame data is read in synchronization with a fast sync signal faster than the sync signal to be written to a frame memory, and a second buffer, to which the previous-frame data read from the frame memory is written in synchronization with the fast sync signal faster than the sync signal, and from which the written previous-frame data is read in synchronization with the above sync signal, for supply to the above driving data generation unit.

14 Claims, 8 Drawing Sheets

CONTROL DEVICE FOR DISPLAY PANEL AND DISPLAY APPARATUS HAVING SAME

CROSS-REFERENCE TO RELATED APPLICATIONS

This application is based upon and claims the benefit of priority from the prior Japanese Patent Application No. 2004-192916, filed on Jun. 30, 2004, the entire contents of which are incorporated herein by reference.

BACKGROUND OF THE INVENTION

1. Field of the Invention

This invention relates to a display panel control device which generates driving signals for a display panel and to a display apparatus having the above control device, and in particular relates to a display panel control device capable of reducing the capacity of the frame memory and a display apparatus having such a control device.

2. Description of the Related Art

Liquid crystal displays, which are one type of display, are coming into widespread use as space-saving display devices. In recent years, they are also coming to be used as display devices for display of video. Liquid crystal display panels have source lines, to which are applied display driving voltages corresponding to a image data for a current frame; gate lines, which are driven with scan timing; and cell transistors and pixel electrodes, placed at a positions of intersection of the above lines. Display driving voltages are applied to a liquid crystal layer across pixel electrodes via a cell transistor to cause changes in a transmittance of the liquid crystal layer, in order to display the desired image.

In general a response characteristics of liquid crystal materials are not satisfactory; there are cases in which, depending on a state of a previous frame, it is not possible to change to a state corresponding to a input grayscale data within a interval of a single frame, and such poor response characteristics may result in degraded video display quality. In order to mitigate such slow response characteristics, driving compensation methods have been proposed in Japanese Patent Laid-open No. 2002-297104(corresponding to U.S. Patent Laid-open US-2002-0140652-A1), Japanese Patent Laid-open No. 2002-6285, and Japanese Patent Laid-open No. 2002-202763.

This driving compensation method, put simply, is a method in which a display driving data for a current frame is generated based on a previous-frame display data and a current-frame display data, and the display panel is driven using this display driving data. Thus by referencing the display data for the previous frame, the display driving data can be generated which takes into account the state of the previous frame.

In Japanese Patent Laid-open No. 2002-297104, a method is described in which a compensation value corresponding to a combination of a post driving state data for the previous frame and the current-frame display data is added to or subtracted from current-frame display data to calculate display driving data for the display data of the current frame. Further, driving at the display driving voltage corresponding to the display driving data does not necessarily result in a liquid crystal layer state corresponding to the display driving data, and so the method is described in which the difference value corresponding to the combination of the post driving state data for the previous frame and the current-frame display data is added to or subtracted from the current-frame display data, the post driving state data is calculated, and the result is stored in frame memory.

As described above, in order to drive a liquid crystal display panel using a driving compensation or other method, the supplied display data for the current frame (or the post driving state data for the current frame to be generated, or other current frame data) is stored in frame memory, and the display driving data for the current frame must be generated from a relation between the display data for the previous frame stored in frame memory (or, the post driving state data or other previous frame data) and the current-frame display data. To this end, the frame memory must store, at least, display data for the previous frame (or the post driving state data, or other previous-frame data) and current-frame display data (or the post driving state data, or other current-frame data), so that large-capacity frame memory is required, and there is the problem of increased costs.

SUMMARY OF THE INVENTION

Hence an object of this invention is to provide a display panel control device enabling use of frame memory with smaller capacity, and a display apparatus using such a device.

In order to attain this object, according to a first perspective of the invention, a display panel control device which generates a display driving data to drive a display panel according to a supplied display data comprises a driving data generation unit which, based on a current-frame display data and on a previous-frame data including either a previous-frame display data or a display-related data generated from the previous-frame display data, generates the display driving data to drive the display panel in synchronization with a sync signal. The display panel control device comprises a first buffer, to which a current-frame data, including either the current-frame display data or a display-related data generated from the current-frame display data, is written in synchronization with the sync signal, and from which the written current-frame data is read in synchronization with a fast sync signal faster than the sync signal to be written to a frame memory, and a second buffer, to which the previous-frame data read from the frame memory is written in synchronization with the fast sync signal faster than the sync signal, and from which the written previous-frame data is read in synchronization with the above sync signal, for supply to the above driving data generation unit. In the frame memory, the previous-frame data is read during a synchronization interval corresponding to the sync signal, and thereafter the current-frame data is written.

In a preferred embodiment of the above first perspective, the display-related data is for example the display driving data, a post driving state data generated from the display driving data, or other data related to the display data. The frame data including either such the display data or the display-related data is stored in the frame memory, and the display panel control device generates the display driving data for the current frame from the current-frame display data and from the previous-frame data stored in the frame memory.

In a preferred embodiment of the above first perspective, the first and second buffer memories are line memories which store one display panel line's worth of data, and the synchronization interval is the horizontal synchronization interval corresponding to the driving interval for one line. Thus by providing one pair of line memories and performing read operations and write operations in parallel at different speeds, the previous-frame data can be read from the frame memory in the first half of the synchronization interval, and the current-frame data can be written to the frame memory in the second half of the synchronization interval.

According to the above first perspective of the invention, in the synchronization interval, the previous-frame data is read from the frame memory via the second frame buffer, after which the current-frame data can be written to the frame memory via the first buffer memory. As a result, the frame memory need only have the capacity to store one frame's worth of data, and so the capacity can be made small. It is preferable that the synchronization interval be for example the horizontal synchronization interval corresponding to one line of the display panel. Or, the interval may correspond to a plurality of lines of the display panel. Also, the fast read clock of the first buffer memory and the fast write clock of the second buffer memory need not necessarily be the same fast clock signal, but may be separate fast clocks such that fast writing of the second buffer memory corresponding to the fast writing of the frame memory, and fast reading of the first buffer memory corresponding to fast reading of frame memory, are completed within the same synchronization interval.

DESCRIPTION OF THE PREFERRED EMBODIMENTS

Figure 1:
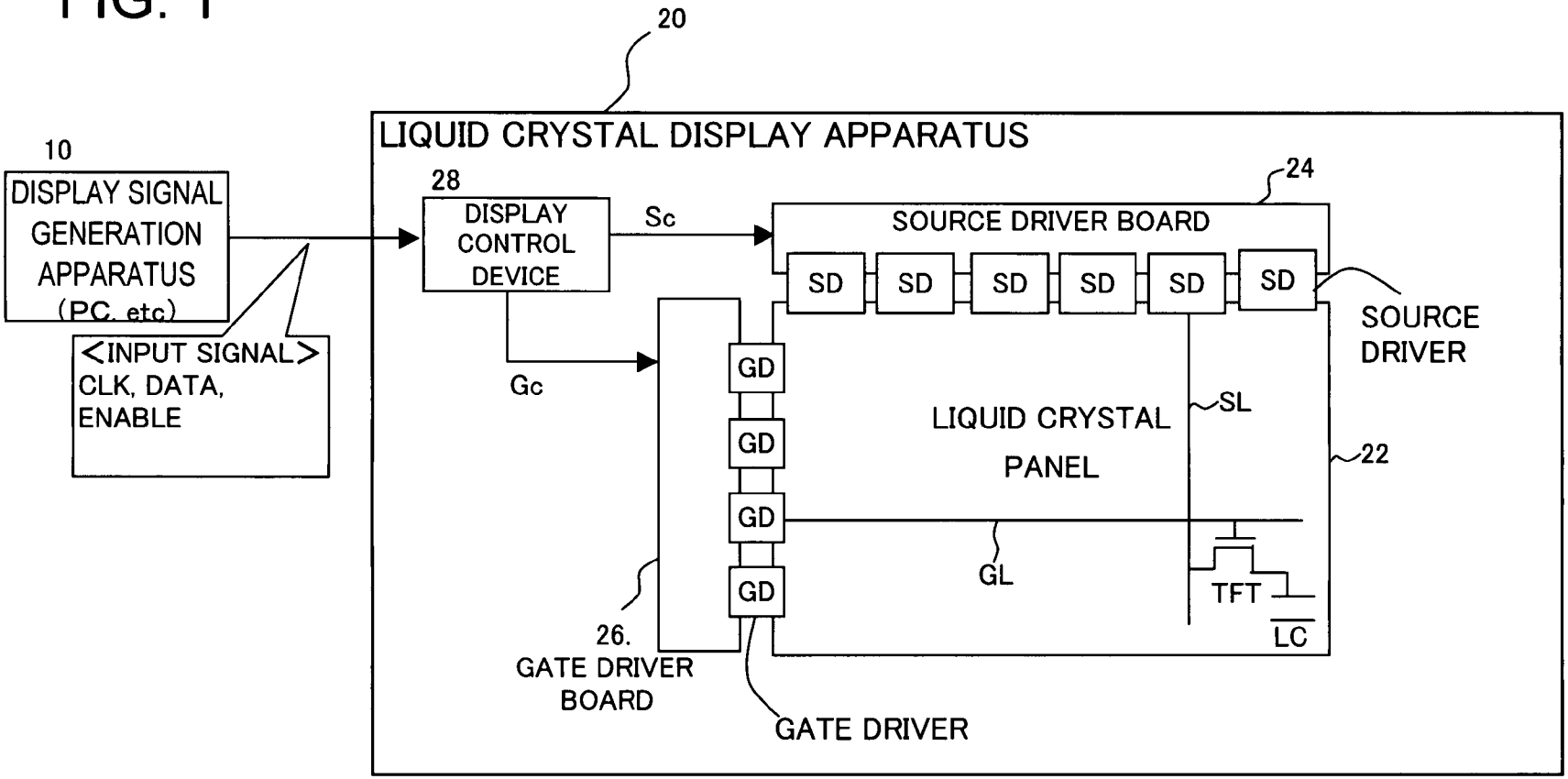
FIG. 1 shows the overall configuration of a liquid crystal display apparatus in one aspect.

Below, aspects of the invention are explained referring to the drawings. However, the technical scope of the invention is not limited to these aspects, but extends to the inventions described in the scope of claims and to inventions equivalent thereto.

FIG. 1 shows the overall configuration of a liquid crystal display apparatus in one aspect. The liquid crystal display apparatus 20 is for example connected to a PC or other display signal generation apparatus 10; and as display input signals, the display signal generation apparatus 10 supplies the liquid crystal display apparatus 20 with a clock CLK, display data DATA for each pixel, and enable signal ENABLE comprising a horizontal sync signal and vertical sync signal. The liquid crystal display apparatus 20 has a liquid crystal panel 22; source driver board 24 on which are mounted source drivers SD; gate driver board 26 on which are mounted gate drivers GD; and a display control device 28 which generates driver control signals Sc, Gc for supply to the source drivers SD and gate drivers GD from the input signals. As shown in the drawing, the liquid crystal display panel 22 has a plurality of gate lines GL in the horizontal direction, a plurality of source lines SL in the vertical direction, and, at the positions of intersections of these, cell transistors TFT and liquid crystal pixels LC. The display control device 28 controls the driving timing of the source drivers SD and gate drivers GD, in synchronization with the clock CLK and enable signal ENABLE from the display signal generation apparatus 10, or in synchronization with an internal clock and internal sync signal generated from these signals. Hence the control signal Sc for source drivers has a source line driving signal and a timing signal therefor, and the control signal Gc for gate drivers has a gate line driving timing signal. The source line driving signal is a signal which corresponds to the driving voltage applied to liquid crystal pixels.

Figure 2:
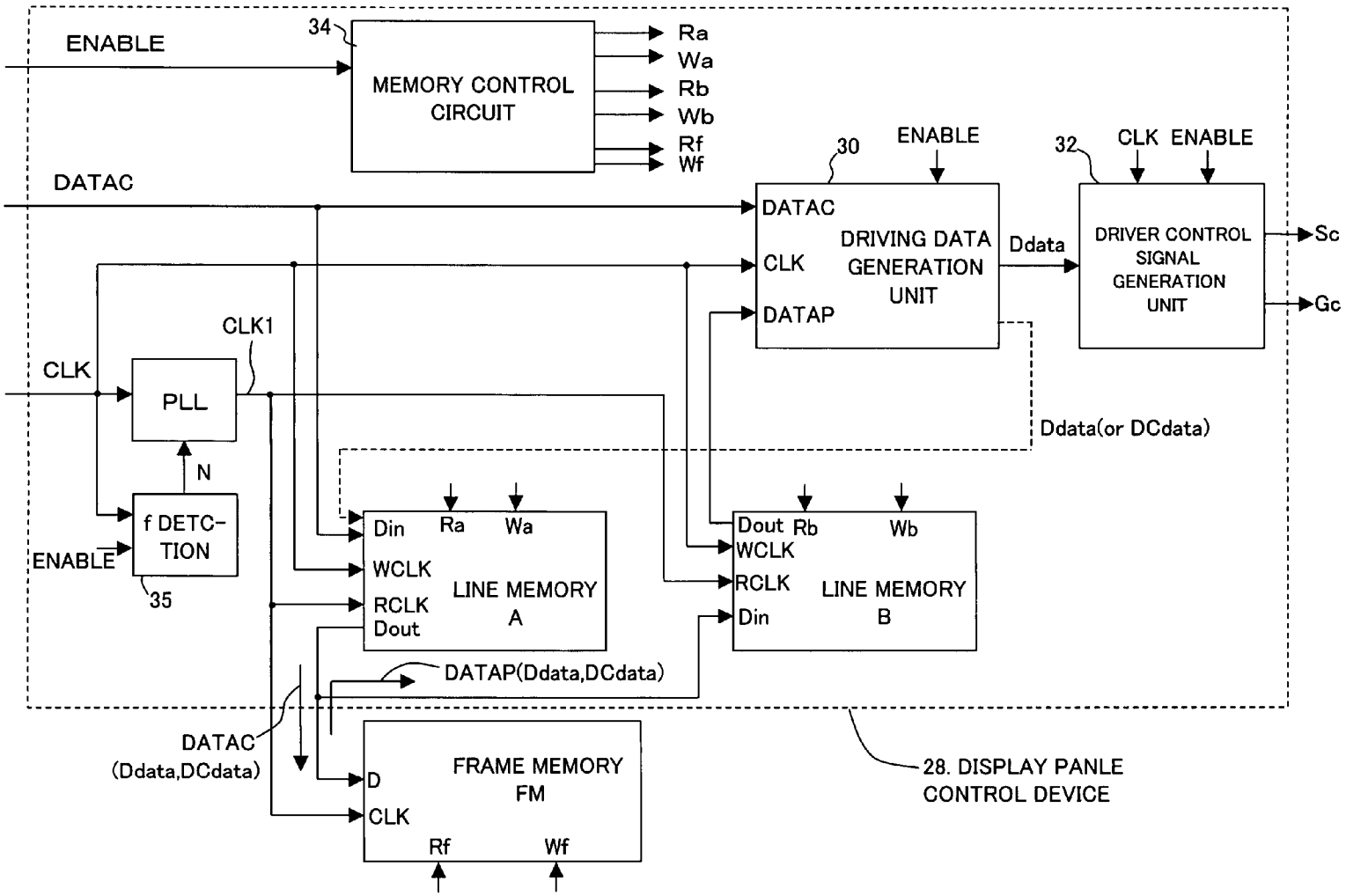
FIG. 2 shows the configuration of a display panel control device in the aspect.

FIG. 2 shows the configuration of a display panel control device in the aspect. This display control device 28 has a driving data generation unit 30 which, based on display data DATAC supplied for the current frame and on the previous-frame display data or on display-related data (previous frame data) DATAP, generates driving data Ddata for display in synchronization with the clock CLK and enable signal ENABLE, and a driver control signal generation unit 32 which, based on this driving data Ddata, the clock CLK and the enable signal ENABLE, generates driver control signals Sc and Gc. Further, the display control device 28 can access a frame memory FM in which is stored the previous-frame display data or display-related data (previous frame data), and has a memory control circuit 34 for this access control. The display control device 28 has a line memory A and line memory B as a pair of memory buffers used to reduce the capacity of frame memory FM to the capacity necessary to store one frame's worth of frame data; control over these line memories is executed by the memory control circuit 34. Further, a PLL circuit is also provided which generates, from the supplied clock CLK, an internal clock CLK1 faster than the clock CLK.

The frame memory FM is for example synchronous DRAM, and has a data input/output terminal D, clock terminal CLK, read-enable terminal Rf, and write-enable terminal Wf. The read-enable terminal Rf and write-enable terminal Wf may be a common control terminal. The frame memory FM has the capacity to store one frame's worth of display data or display-related data (frame data). As with ordinary memory, frame memory FM with such a large capacity employs time division to perform write operations and read operations via a common data input/output terminal D.

On the other hand, the line memories A and B which are buffer memory units are both dual-port memories and have a separate data input terminal Din and data output terminal Dout, so that write operations and read operations can be performed simultaneously. Hence when a write clock WCLK and read clock RCLK are input, based on the write enable signals Wa, Wb and read enable signals Ra, Rb, write operations and read operations can be separately controlled for the respective terminals Din and Dout.

As the write clock WCLK, the clock CLK is supplied to line memory A, and display data for the current frame DATAC (or display-related data Ddata, DCdata, or other current-frame data) is written to line memory A according to the timing speed at which the supplied display data for the current frame DATAC is supplied. As the read clock RCLK, the fast clock CLK1 is supplied to line memory A, and the current-frame display data DATAC (or the display-related data Ddata, DCdata, or other current-frame data) is read at rate faster than the rate of supply of display data and is written to frame memory FM.

As the write clock WCLK, the fast clock CLK1 is supplied to line memory B, and the previous-frame display data DATAP (or the display-related data Ddata, DCdata, or other previous-frame data) read from frame memory FM is written to line memory B. As the read clock RCLK, the fast clock CLK1 is supplied to line memory B, and the previous-frame display data DATAP (or the display-related data Ddata, DCdata or other previous-frame data) is read from line memory B according to the timing speed at which the supplied display data for the current frame DATAC is supplied and is supplied to the driving data generation unit 30.

The memory control circuit 34 generates read enable signals Ra, Rb, Rf and write enable signals Wa, Wb, Wf for the line memories A, B and frame memory FM, and controls each of these memory units. In the drawing, memory addresses are omitted.

Figure 3:
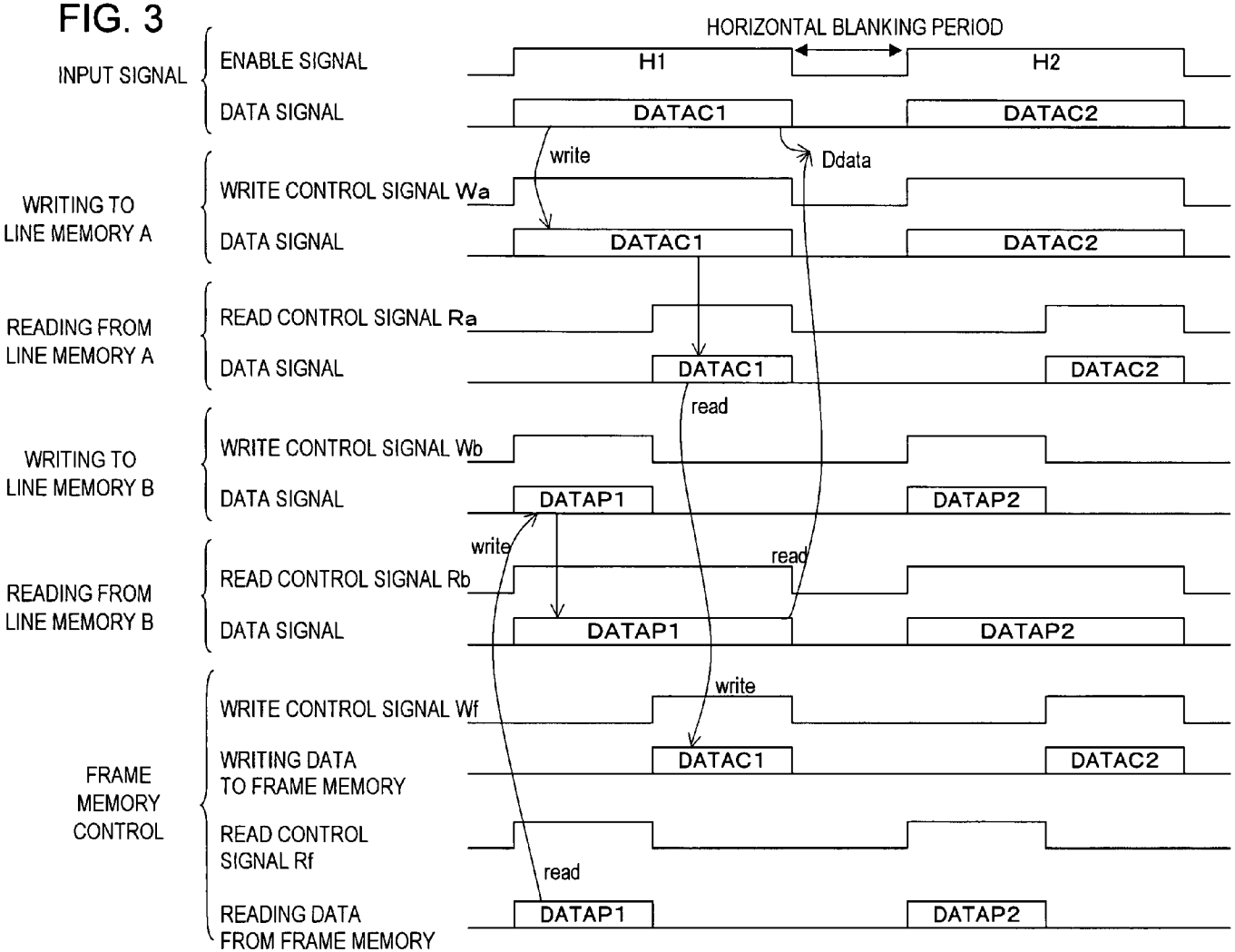
FIG. 3 is an operating waveform diagram for the display control device in the aspect.

FIG. 3 is an operating waveform diagram for the display control device in the aspect. In this aspect, the current-frame data of the display data for the current frame or the display-related data Ddata, DCdata is written to frame memory, and similar previous-frame data is read from frame memory; but in the following explanation of operation as shown in FIG. 3, an example is explained in which display data for the current frame is used as the current-frame data, and display data for the previous frame is used as the previous-frame data. FIG. 3 shows an example in which the fast clock CLK1 generated by the PLL circuit is at twice the frequency of the input clock CLK.

The enable signal ENABLE which is input is a signal which goes to H level during the horizontal synchronization intervals H1, H2, and goes to L level during blank intervals. Though not shown, the timing of the vertical synchronization can be identified by blank intervals which are longer than the blank intervals between horizontal synchronization intervals. The display data for the current frame DATAC1, DATAC2 is input in synchronization with the horizontal synchronization intervals H1, H2 of this enable signal.

The display data for the current frame DATAC1 input in the horizontal synchronization interval H1 is input in synchronization with the clock CLK and is supplied to the driving data generation unit 30, as well as being written to frame memory FM via the line memory A. That is, the input display data for the current frame DATAC1 is written to line memory A in synchronization with the clock CLK over the entire interval of the horizontal synchronization interval H1. On the other hand, the display data for the previous frame DATAP1 is read from frame memory FM during the first half of the horizontal synchronization interval H1 in synchronization with the fast clock CLK1, and this display data DATAP1 is written to line memory B in synchronization with the same fast clock CLK1. And, the display data for the previous frame DATAP1 written as described above is read from the line memory B in synchronization with the clock CLK over the entire interval of the horizontal synchronization interval H1, and is supplied to the driving data generation unit 30. The driving data generation unit 30 is supplied with the display data for the current frame DATAC1 and the display data for the previous frame DATAP1 in synchronization with the clock CLK, and based on the two sets of display data generates display driving data Ddata and post driving state data DCdata. And, previously written display data for the current frame DATAC1 is read from the line memory A in synchronization with the fast clock CLK1 in the second half of the horizontal synchronization interval H1, and this display data is written to frame memory FM in synchronization with the same fast clock CLK1.

As described above, line memory A and line memory B with a dual-port configuration are provided in the display control device 28; display data for the current frame DATAC1 is written to frame memory FM via the line memory A in the second half of the horizontal synchronization interval H1, and display data for the previous frame DATAP1 is read from frame memory FM in the first half of the horizontal synchronization interval H1 and is supplied via the line memory B to the driving data generation unit 30. That is, reading of previous-frame data from frame memory FM and writing of current-frame data to frame memory FM are performed by time division in the first half and in the second half respectively of the same horizontal synchronization interval, so that the frame memory capacity can be reduced that that of a single frame. Hence the fast clock CLK1 need only be fast enough to enable completion, within one horizontal synchronization interval, of reading and writing of one frame's worth of frame data from and to frame memory. That is, when access to line memories A and B and frame memory is controlled using the same fast clock CLK1, the fast clock CLK1 must have a frequency at least two times that of the supplied clock CLK. In cases where access to the line memories A and B is controlled using separate fast clocks, the frequencies must be such as to enable operations to read from and write to frame memory to be completed within a single horizontal synchronization interval, such as for example when one is three times and the other is 1.5 times the frequency of the supplied clock CLK. However, in this case the clock for accessing frame memory must also be made to correspond to the fast clocks for the line memories A and B.

The driving data generation unit 30 generates display driving data Ddata based on the supplied current-frame display data DATAC1 and on the previous-frame display data DATAP1 read from frame memory FM via the line memory B, and supplies this driving data to the driver control signal generation unit 32. In addition to the display driving data Ddata, the driving data generation unit 30 also generates as necessary the post driving state data DCdata, which is the state resulting from driving the panel using the display driving data, from the current-frame display data. Also, the display driving data Ddata or post driving state data DCdata is written as necessary, as display-related data, to frame memory FM as current-frame data. In this case, the driving data generation unit 30 generates display driving data Ddata for the current frame based on current-frame display data and on the display-related data Ddata or DCdata for the previous frame, stored in frame memory. This generation of display driving data is as described in the above-mentioned Japanese Patent Laid-open No. 2002-297104.

The synchronization clock supplied to each of the memory units and to the driving data generation unit may be a clock and fast clock generated independently by the display control device 28, instead of the clock CLK supplied externally together with the display data and the fast clock CLK1 generated therefrom.

Figure 4:
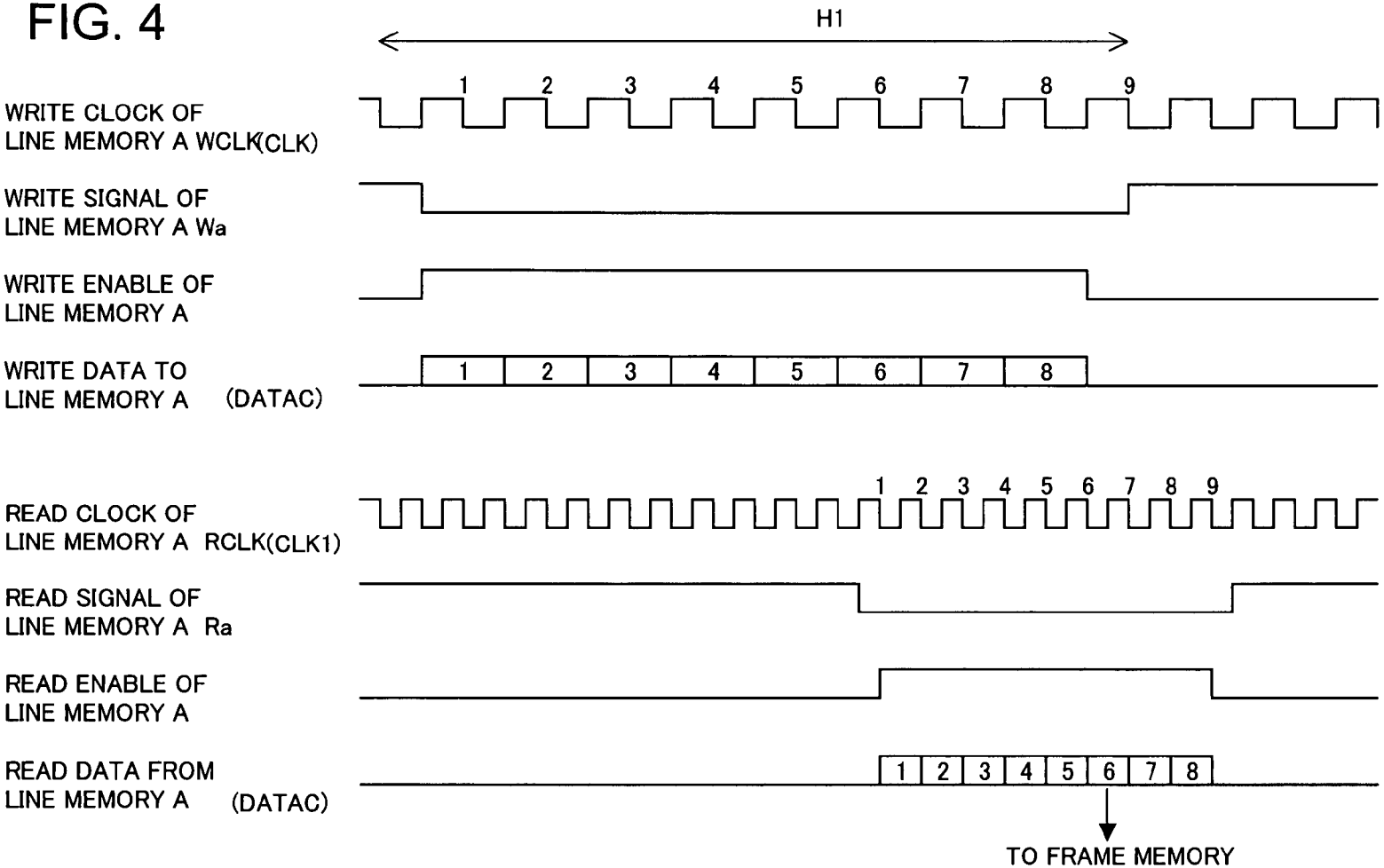
FIG. 4 is a timing waveform diagram showing operation of line memory A.

FIG. 4 is a timing waveform diagram showing operation of the line memory A. The write clock WCLK is the supplied clock CLK; during the interval in which the write enable signal Wa is at L level (an entire interval of the horizontal synchronization interval H1), display data DATAC for eight pixels of the current frame is written in synchronization with the write clock WCLK. The enable signal ENABLE for writing indicates the interval in which the write enable signal Wa is at L level and the display data for 8 pixels, synchronized with the clock CLK, is valid. In the second half of the horizontal synchronization interval H1, during the interval in which the read enable signal Ra is at L level, display data DATAC for 10 pixels of the current frame is read from the line memory A in synchronization with the read clock RCLK at twice the frequency and is written to frame memory. The enable signal ENABLE for reading likewise indicates the interval in which the read enable signal Ra is at L level and display data for 8 pixels, synchronized with the clock CLK1, is valid. Thus by transferring data through the line memory A, the interval of writing to frame memory can be made a short interval in the second half of the horizontal synchronization interval H1. As explained above, in place of the display data, display driving data, post driving state data, or other display-related data may be written to frame memory via the line memory A.

Figure 5:
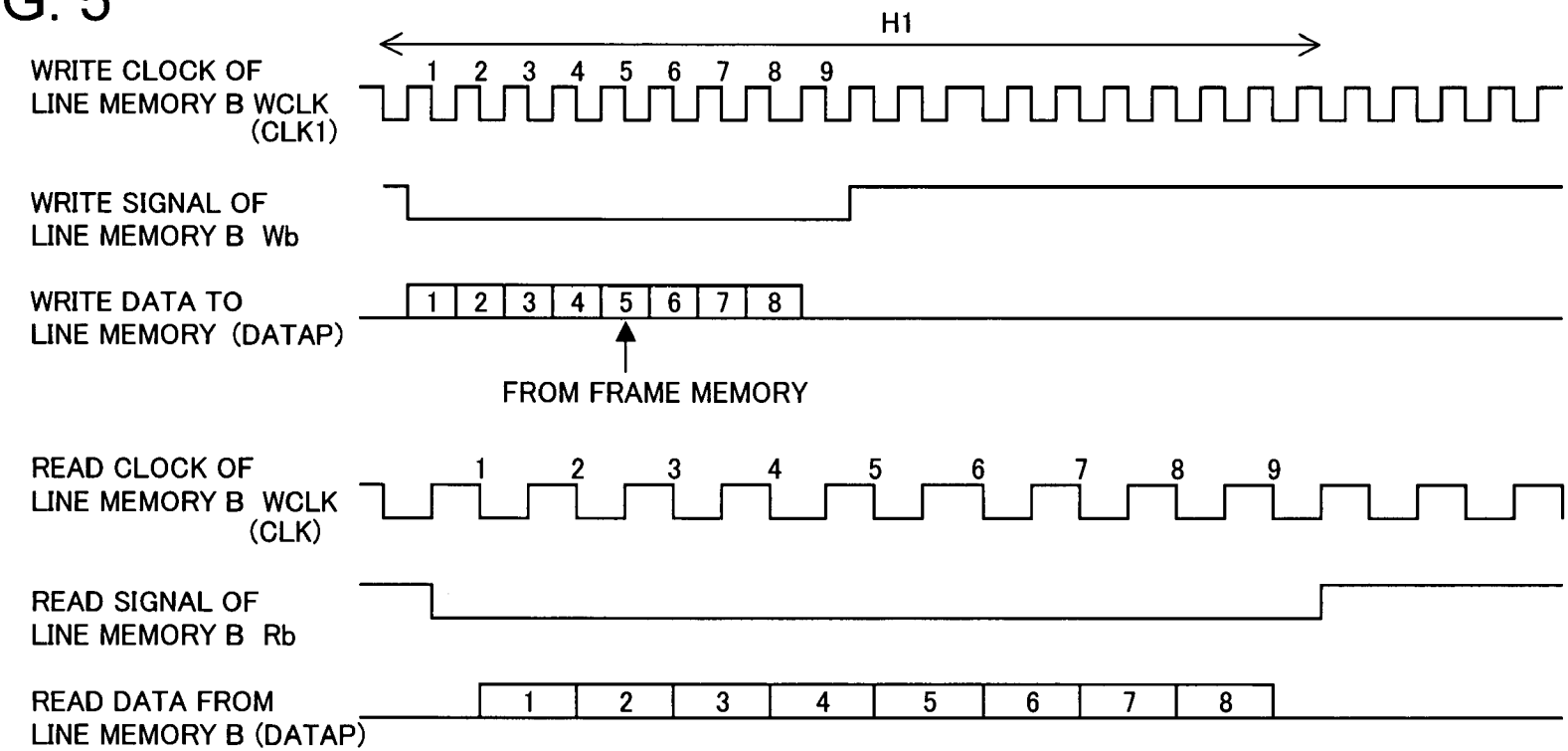
FIG. 5 is a timing waveform diagram showing operation of line memory B.

FIG. 5 is a timing waveform diagram showing operation of line memory B. The write clock WCLK is the fast clock CLK1; in the first half of the horizontal synchronization interval H1, while the write enable signal Wb is at L level, previous-frame display data DATAP for 8 pixels is written in synchronization with the write clock WCLK. This previous-frame data was read from frame memory in synchronization with the fast clock CLK1. Over the entire interval of the horizontal synchronization interval H1, previous-frame display data DATAP for 8 pixels is read from line memory A while the read enable signal Ra is at H level in synchronization with the slow read clock RCLK and supplied to the driving data generation unit 30. As explained above, in place of the display data, display driving data, post driving state data, or other display-related data may be read from frame memory via the line memory A.

Figure 6:
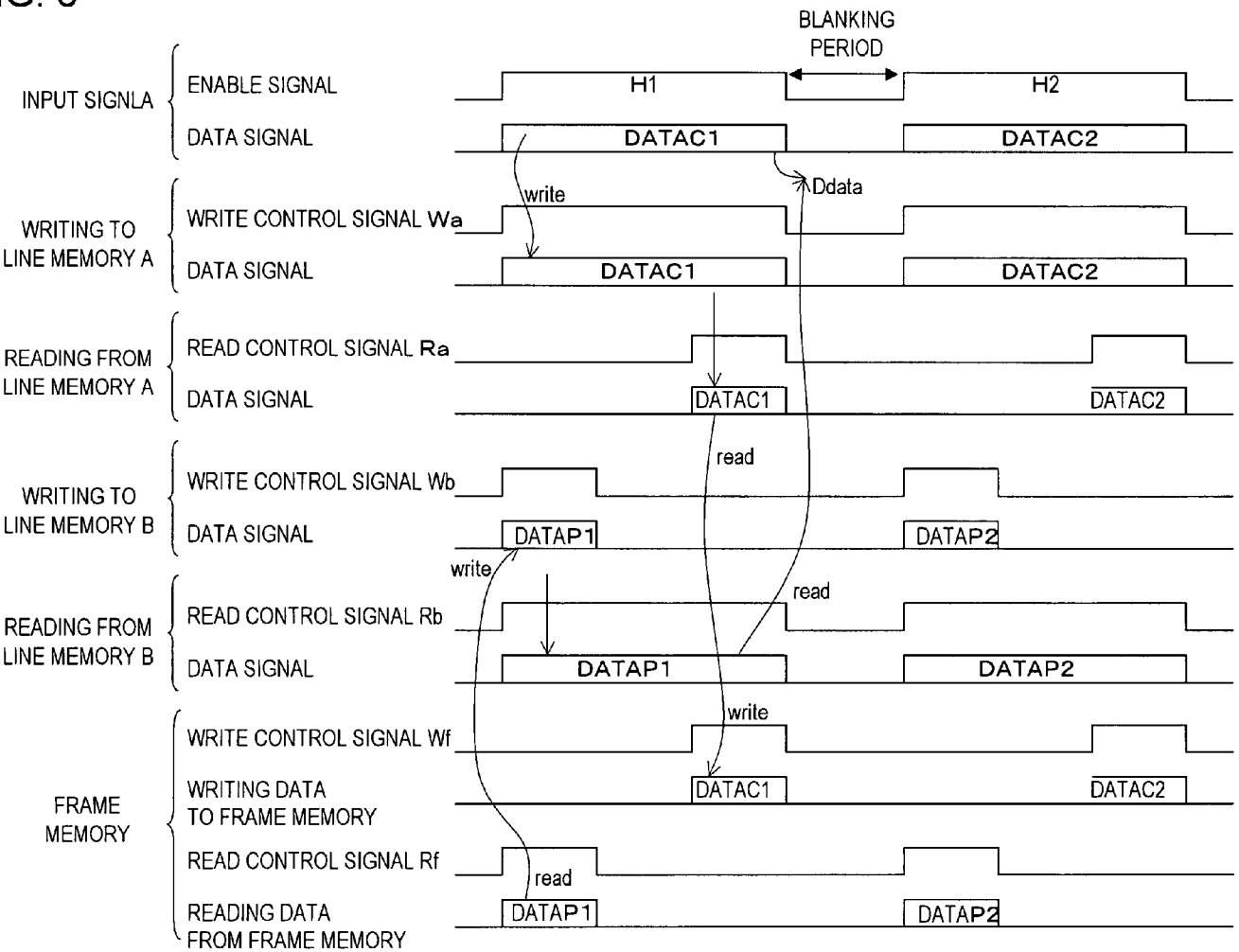
FIG. 6 is another operating waveform diagram for the display control device in the aspect.

FIG. 6 is another operating waveform diagram for the display control device in the aspect. In this example, a fast clock CLK1 at three times the frequency of the supplied clock CLK is generated by the PLL circuit. In this example also, similarly to FIG. 3, previous-frame data is read from the frame buffer in the first half of the horizontal synchronization interval H1 and is supplied to the driving data generation unit via the line memory B, and current-frame data is written to the frame memory via the line memory A in the second half of the horizontal synchronization interval H1. However, the frequency of the fast clock CLK1 is three times that of the supplied clock CLK, so that previous-frame data DATAP is read from frame memory in the initial one-third of the horizontal synchronization interval H1 and is written to the line memory B. And, current-frame data is read from the line memory A in the last one-third of the horizontal synchronization interval H1 and is written to frame memory. By using a still faster clock, a larger margin can be provided between the interval of frame memory read operations and the interval of frame memory write operations.

Figure 7:
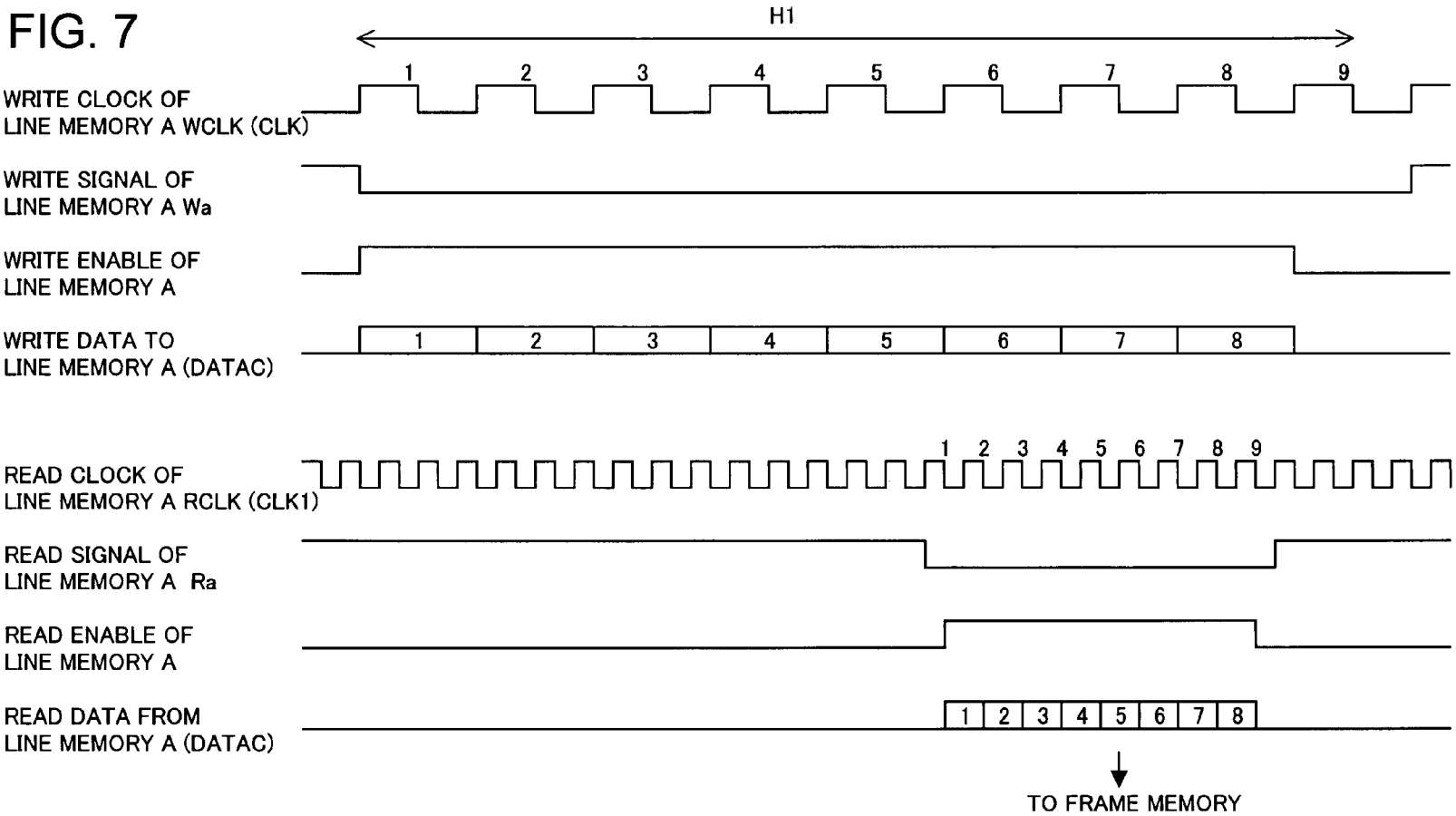
FIG. 7 is a timing waveform diagram showing operation of line memory A; and, FIG. 8 is a timing waveform diagram showing operation of line memory B.

FIG. 7 is a timing waveform diagram showing operation of line memory A. Similarly to FIG. 4, over the entire horizontal synchronization interval H1, current-frame data DATAC for 8 pixels is written to the line memory A in synchronization with the clock CLK. But in contrast with FIG. 4, current-frame data DATAC for 8 pixels is read over the last one-third of the horizontal synchronization interval H1 in synchronization with the fast clock CLK1 and is written to frame memory.

Figure 8:
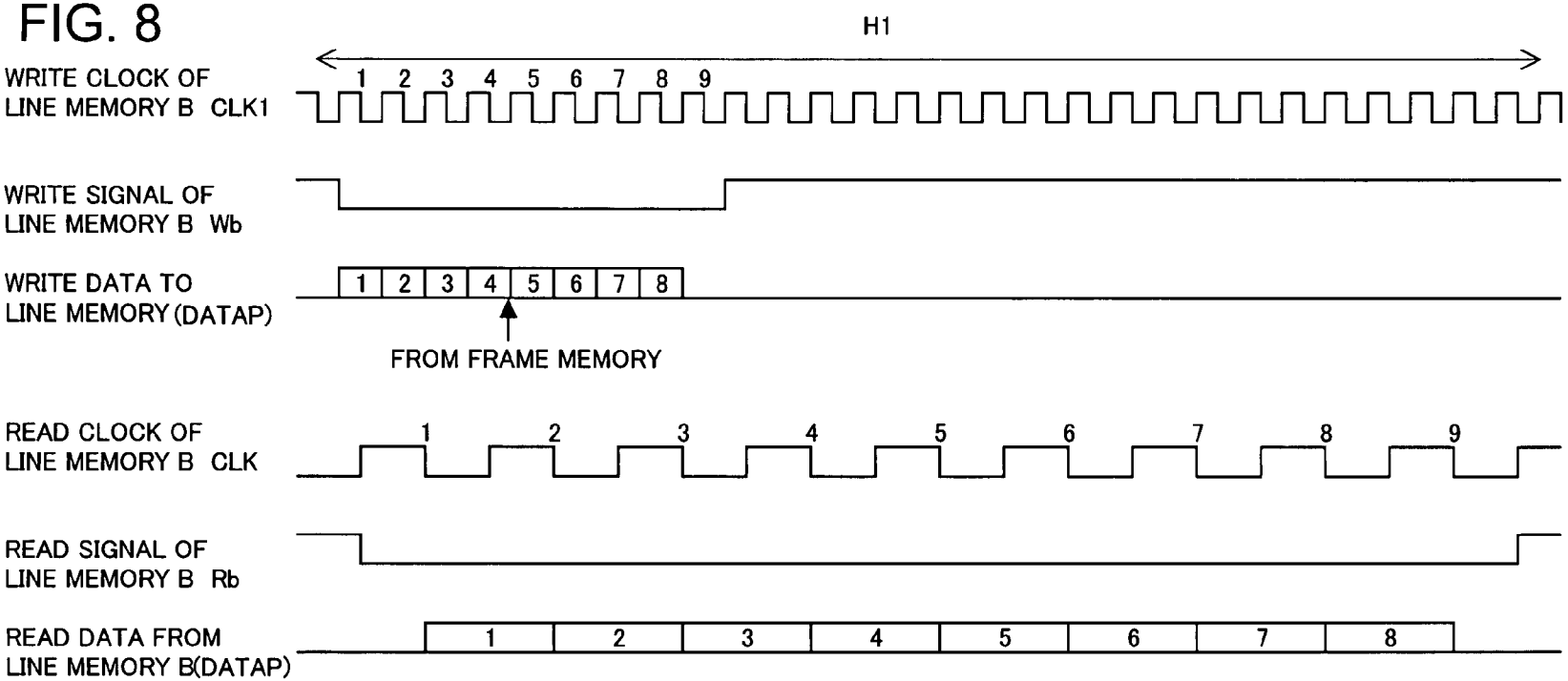

FIG. 8 is a timing waveform diagram showing operation of line memory B. In contrast with FIG. 5, previous-frame data DATAP is read from frame memory during the initial one-third of the horizontal synchronization interval H1 and is written to the line memory B. On the other hand, similarly to FIG. 5, over the entire horizontal synchronization interval H1 previous-frame data DATAP is read in synchronization with the clock CLK and is supplied to the driving data generation unit.

The above-described previous-frame data DATAP and current-frame data DATAC are either display data, or display-related data (display driving data Ddata or post driving state data DCdata) generated from the display data.

When for example the supplied clock CLK is slow, it is desirable that the frequency of the fast clock CLK1 generated by the PLL circuit be at three times the frequency of the supplied clock CLK, and when the supplied clock CLK is fast, that the fast clock CLK1 be at two times the frequency, so as to maintain the same fast access to line memory and frame memory. In this case, the frequency detection circuit 35 in FIG. 2 detects the frequency of the supplied clock CLK and controls the frequency of the fast clock CLK1 generated by the PLL circuit according to the detected frequency.

What is claimed is:

1. A display panel control device, which generates a display driving data to drive a display panel according to supplied display data, comprising:

a driving data generation unit, which generates the display driving data to drive the display panel in synchronization with a synchronization signal, based on a current-frame display data and on a previous-frame data including either a previous-frame display data or a display-related data generated from the previous-frame display data;

a first buffer memory, to which a current-frame data, including either the current-frame display data or a display-related data generated from the current-frame display data, is written in synchronization with the synchronization signal, and from which the written current-frame data is read in synchronization with a fast synchronization signal faster than the synchronization signal, for writing to a frame memory;

a second buffer memory, to which the previous-frame data read from the frame memory is written in synchronization with a fast synchronization signal faster than the synchronization signal, and from which the written previous-frame data is read in synchronization with the synchronization signal, for supplying to the driving data generation unit;

a fast synchronization signal generating unit which generates the fast synchronization signal: and a frequency detection unit which controls a frequency of the fast synchronization signal generated by the fast synchronization unit so that the frequency of the fast synchronization signal maintains same fast access to the first and second buffer memories and the frame memory; wherein during a synchronization interval corresponding to the synchronization signal, the previous-frame data is read from the frame memory and then the current-frame data is written to the frame memory.

2. The display panel control device according to claim 1, wherein the display-related data is data either including the display driving data or a post driving state data indicating the state after driving using the display driving data.

3. The display panel control device according to claim 1, wherein the first and second buffer memories are line memories which store a data for one line of the display panel, and the synchronization interval is a horizontal synchronization interval corresponding to a driving interval for one line.

4. The display panel control device according to claim 1, wherein the fast synchronization signal is sufficiently fast for read operations and write operations of the frame memory to be completed within the synchronization interval.

5. A display panel control device, which generates a display driving data to drive a display panel according to supplied display data, comprising:

a driving data generation unit, which generates the display driving data to drive the display panel in synchronization with a synchronization signal, based on a current-frame display data and on a previous-frame data related to a previous-frame display data;

a first line memory, to which a current-frame data related to the current-frame display data is written during a horizontal synchronization interval in synchronization with the synchronization signal, and from which the written current-frame data is read during the interval of the second half of the horizontal synchronization interval in synchronization with a fast synchronization signal faster than the synchronization signal, for writing to a frame memory;

a second line memory, to which the previous-frame data read from the frame memory is written during the interval of the first half of the horizontal synchronization interval in synchronization with a fast synchronization signal faster than the synchronization signal, and from which the written previous-frame data is read during the horizontal synchronization interval in synchronization with the synchronization signal, for supplying to the driving data generation unit;

a fast synchronization signal generating unit which generates the fast synchronization signal; and a frequency detection unit which controls a frequency of the fast synchronization signal generated by the fast synchronization unit so that the frequency of the fast synchronization signal maintains same fast access to the first and second line memories and the frame memory; wherein during a horizontal synchronization interval, the previous-frame data is read from the frame memory and then the current-frame data is written to the frame memory.

6. The display panel control device according to claim 5, wherein the current-frame data or the previous-frame data related to the display data is either the display data, or the display driving data, or a post driving state data indicating the state after driving using the display driving data.

7. The display panel control device according to claim 5, wherein the fast synchronization signal for the first line memory and second line memory is a common fast synchronization signal, and the fast synchronization signal is a clock signal at least twice as fast as the synchronization signal.

8. A display apparatus, comprising a display panel and a display panel control device which generates a display driving data to drive the display panel according to supplied display data, wherein the display panel control device further comprising:

a driving data generation unit, which generates the display driving data to drive the display panel in synchronization with a synchronization signal, based on a current-frame display data and on a previous-frame data including either a previous-frame display data or a display-related data generated from the previous-frame display data;

a first buffer memory, to which a current-frame data, including either the current-frame display data or a display-related data generated from the current-frame display data, is written in synchronization with the synchronization signal, and from which the written current-frame data is read in synchronization with a fast synchronization signal faster than the synchronization signal, for writing to a frame memory;

a second buffer memory, to which the previous-frame data read from the frame memory is written in synchronization with a fast synchronization signal faster than the synchronization signal, and from which the written previous-frame data is read in synchronization with the synchronization signal, for supplying to the driving data generation unit;

a fast synchronization signal generating unit which generates the fast synchronization signal; and a frequency detection unit which controls a frequency of the fast synchronization signal generated by the fast synchronization unit so that the frequency, of the fast synchronization signal maintains same fast access to the first and second buffer memories and the frame memory; wherein during a synchronization interval corresponding to the synchronization signal, the previous-frame data is read from the frame memory and then the current-frame data is written to the frame memory.

9. The display apparatus according to claim 8, wherein the display panel is a liquid crystal display panel.

10. A display apparatus, comprising a display panel and a display panel control device which generates a display driving data to drive the display panel according to supplied display data, wherein the display panel control device further comprising:

a driving data generation unit, which generates a display driving data to drive the display panel in synchronization with a synchronization signal, based on a current-frame display data and on a previous-frame data related to a previous-frame display data;

a first line memory, to which a current-frame data related to the current-frame display data is written during a horizontal synchronization interval in synchronization with the synchronization signal, and from which the written current-frame data is read during a interval of the second half of the horizontal synchronization interval in synchronization with a fast synchronization signal faster than the synchronization signal, for writing to frame memory;

a second line memory, to which the previous-frame data read from the frame memory is written during a interval of the first half of the horizontal synchronization interval in synchronization with a fast synchronization signal faster than the synchronization signal, and from which the written previous-frame data is read during the horizontal synchronization interval in synchronization with the synchronization signal, for supplying to the driving data generation unit;

a fast synchronization signal generating unit which generates the fast synchronization signal; and a frequency detection unit which controls a frequency of the fast synchronization signal generated by the fast synchronization unit so that the frequency of the fast synchronization signal maintains same fast access to the first and second line memories and the frame memory; wherein during the horizontal synchronization interval, the previous-frame data is read from the frame memory and then the current-frame data is written to the frame memory.

11. The display apparatus according to claim 10, wherein the display panel is a liquid crystal display panel.

12. A display panel control method for generating a display driving data to drive a display panel according to supplied display data, the method comprising:

generating a fast synchronization signal;

controlling a frequency of the fast synchronization signal so that the frequency of the fast synchronization signal maintains fast access to a first and second buffer memories and frame memory, by a frequency detection unit;

generating the display driving data to drive the display panel in synchronization with a synchronization signal, by a driving data generation unit, based on a current-frame display data and on a previous-frame data including either a previous-frame display data or a display-related data generated from the previous-frame display data;

writing a current-frame data including either the current-frame display data or a display-related data generated from the current-frame display data, to the first buffer memory, in synchronization with the synchronization signal, and reading the written current-frame data from the first memory in synchronization with the fast synchronization signal faster than the synchronization signal, for writing to the frame memory;

writing the previous-frame data read from the frame memory to the second buffer memory in synchronization with the fast synchronization signal faster than the synchronization signal, and reading the written previous-frame data from the second buffer memory in synchronization with the synchronization signal, for supplying to the driving data generation unit; and wherein during the synchronization interval corresponding to the synchronization signal, the previous-frame data is read from the frame memory and then the current-frame data is written to the frame memory.

13. A display panel control method for generating a display driving data to drive a display panel according to supplied display data, the method comprising:

generating a fast synchronization signal:

controlling a frequency of the fast synchronization signal so that the frequency of the fast synchronization signal maintains fast access to a first and second line memories and frame memory, by a frequency detection unit;

generating the display driving data to drive the display panel in synchronization with a synchronization signal, by a driving data generation unit, based on a current-frame display data and on a previous-frame data related to a previous-frame display data;

writing a current-frame data related to the current-frame display data to the first line memory during a horizontal synchronization interval in synchronization with the synchronization signal, and reading the written current-frame data from the first line memory during the interval of the second half of the horizontal synchronization interval in synchronization with the fast synchronization signal faster than the synchronization signal, for writing to the frame memory; and, writing the previous-frame data read from the frame memory to the second line memory during the interval of the first half of the horizontal synchronization interval in synchronization with the fast synchronization signal faster than the synchronization signal, and reading the written previous-frame data from the second line memory during the horizontal synchronization interval in synchronization with the synchronization signal, for supplying to the driving data generation unit; wherein during the horizontal synchronization interval, the previous-frame data is read from the frame memory and then the current-frame data is written to the frame memory.

14. The display panel control device according to claim 7, wherein a frequency of the common fast synchronization signal is selected appropriately according to a frequency of the synchronization signal corresponding to the supplied signal.

* * * * *